United States Patent [19]

Frazier

[11] 3,938,776

[45] Feb. 17, 1976

[54] FORMING PANEL WITH CONNECTION MEANS FOR ABUTTING PANELS

[76] Inventor: Stanley J. Frazier, 3206 S. Hudson St., Seattle, Wash. 98118

[22] Filed: Feb. 7, 1972

[21] Appl. No.: 224,218

Related U.S. Application Data

[62] Division of Ser. No. 77,935, Oct. 5, 1970, Pat. No. 3,687,411.

[52] U.S. Cl. ..... 249/114; 249/190; 249/192

[51] Int. Cl.[2] ..... E04G 9/05

[58] Field of Search ..... 249/191, 192, 195, 196, 249/44–47, 219 W, 189, 114

[56] References Cited

UNITED STATES PATENTS

| | | | |
|---|---|---|---|
| 737,950 | 9/1903 | McCann | 249/195 |
| 775,666 | 11/1904 | Shute et al. | 249/27 |
| 910,883 | 1/1909 | Turkington | 249/22 |
| 1,815,368 | 7/1931 | Wotnoske | 249/47 X |
| 1,823,195 | 9/1931 | Gremel | 249/196 |
| 3,007,221 | 11/1961 | Kenney | 249/219 W X |
| 3,291,436 | 12/1966 | Berghammer | 249/26 |
| 3,307,822 | 3/1967 | Stout | 249/189 |
| 3,327,986 | 6/1967 | Oury | 249/45 |
| 3,481,575 | 12/1969 | Arrighini | 249/45 |

*Primary Examiner*—Robert D. Baldwin
*Assistant Examiner*—John McQuade
*Attorney, Agent, or Firm*—Christensen, O'Connor, Garrison & Havelka

[57] ABSTRACT

A readily assembled and readily stripped, reusable concrete form is constructed from a plurality of similar flat-faced panels having spaced, co-planar, open-ended edge-oriented slots in the margins of the other or opposite faces thereof; and a plurality of elongated L-shaped keys which are employed both to interlock the panels on each side of the form, and to interlock the form from side to side. The panels are arranged in two spaced, parallel, oppositely disposed, edge to edge, co-planar flat-faced arrays of the same; and are interlocked with one another in each array by placing a first set of the keys in the plane of the slots opposite points relatively within the margins of the panels, and slidably engaging the keys in the adjacent slots of adjacent panels. The arrays are interlocked with one another by placing a second set of the keys in the plane of the slots opposite points relatively without the margins of the panels, slidably engaging the latter keys in the slots of the panels along corresponding edges of the arrays, and interconnecting the latter keys with one another transversely of the space between the arrays.

5 Claims, 16 Drawing Figures

Fig. 1
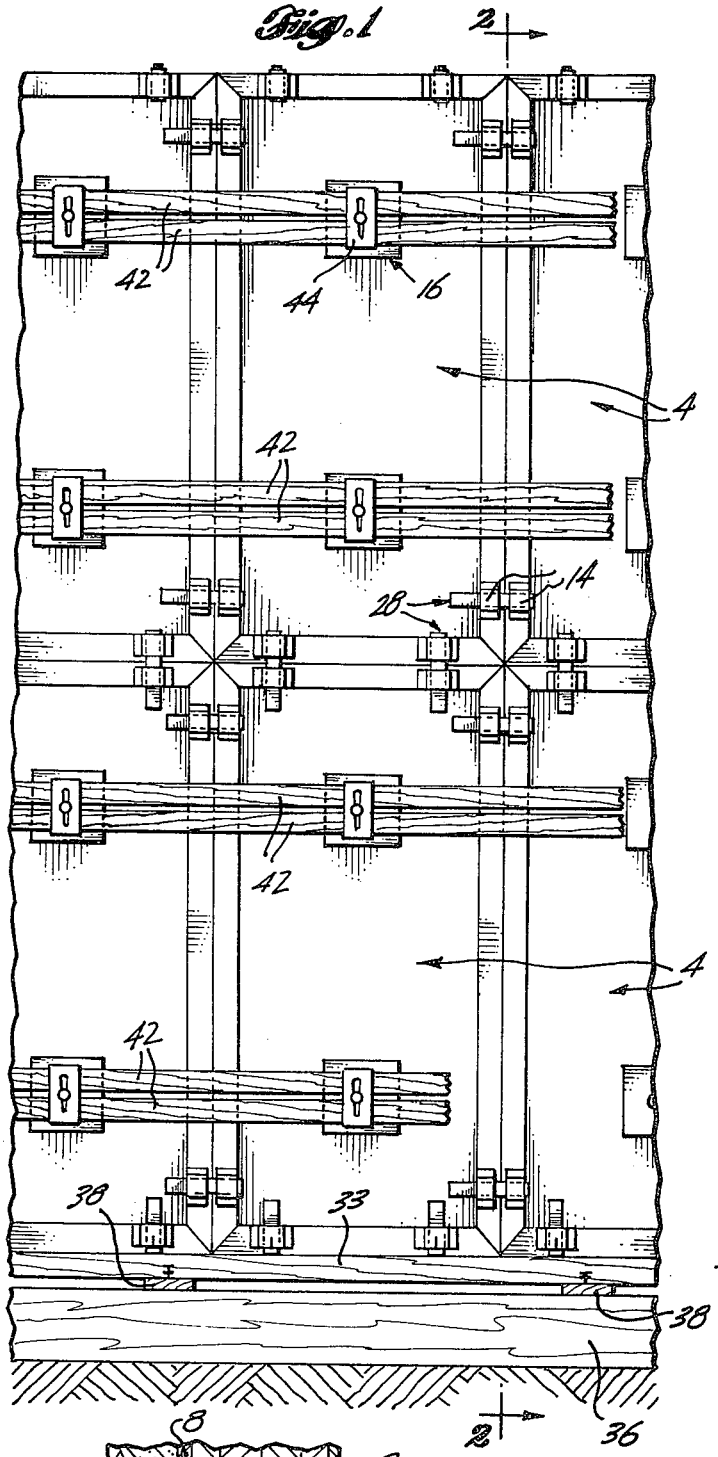
Fig. 2.
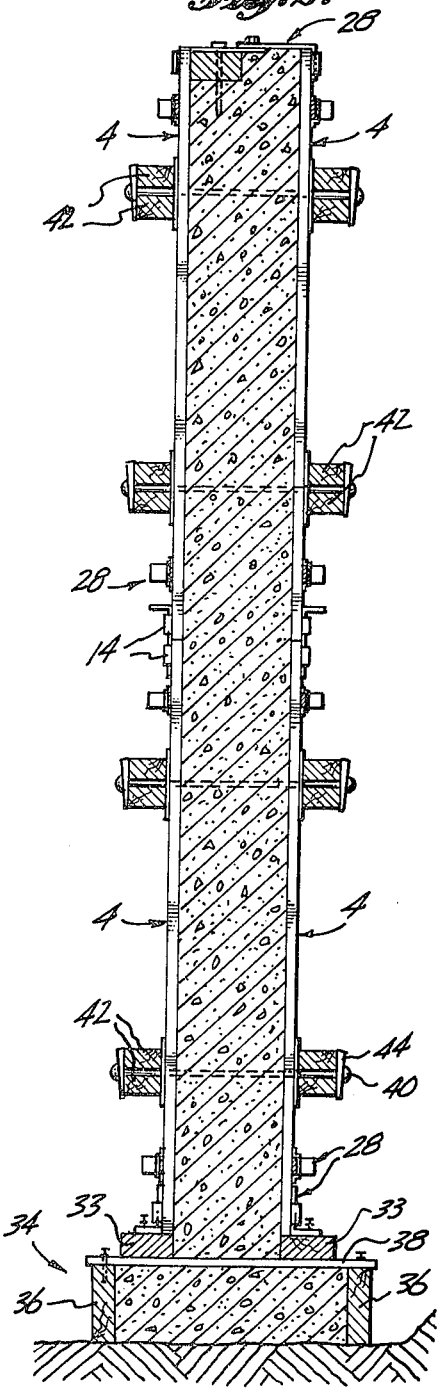
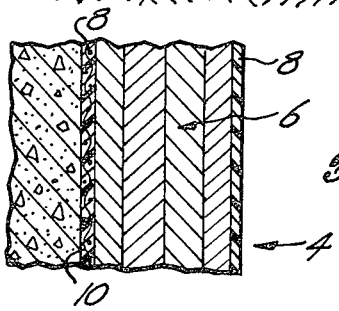
Fig. 3.

Fig. 4.
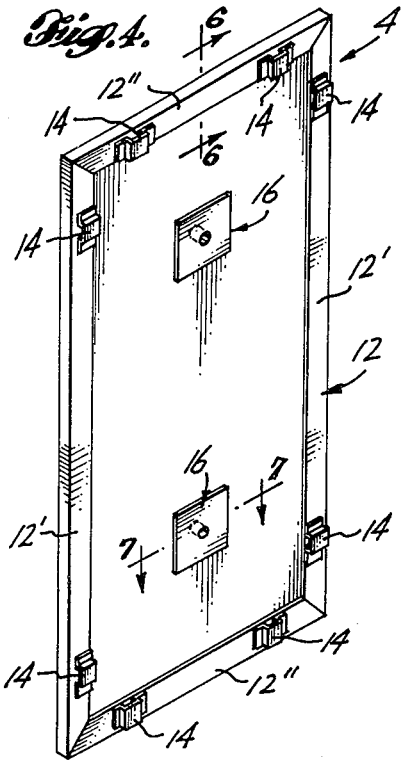
Fig. 5.
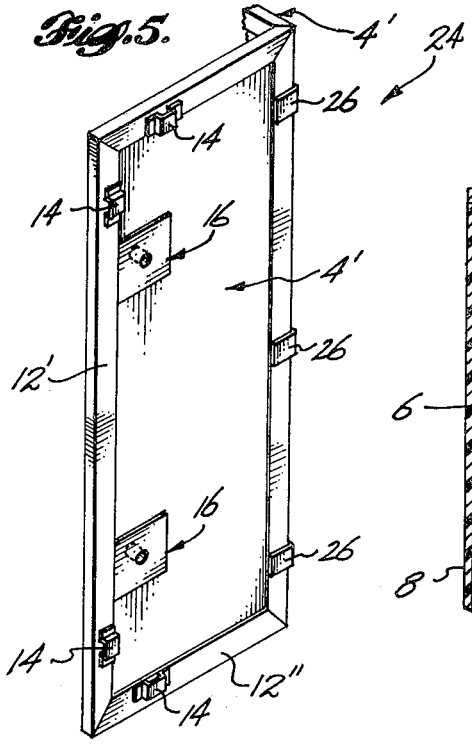
Fig. 6.
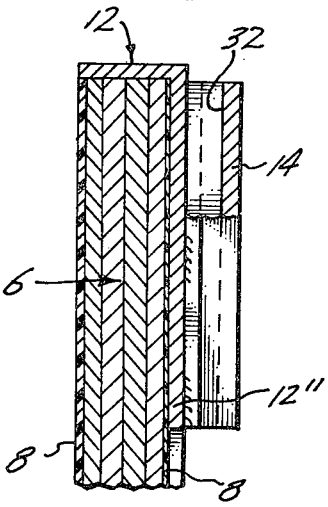
Fig. 3.
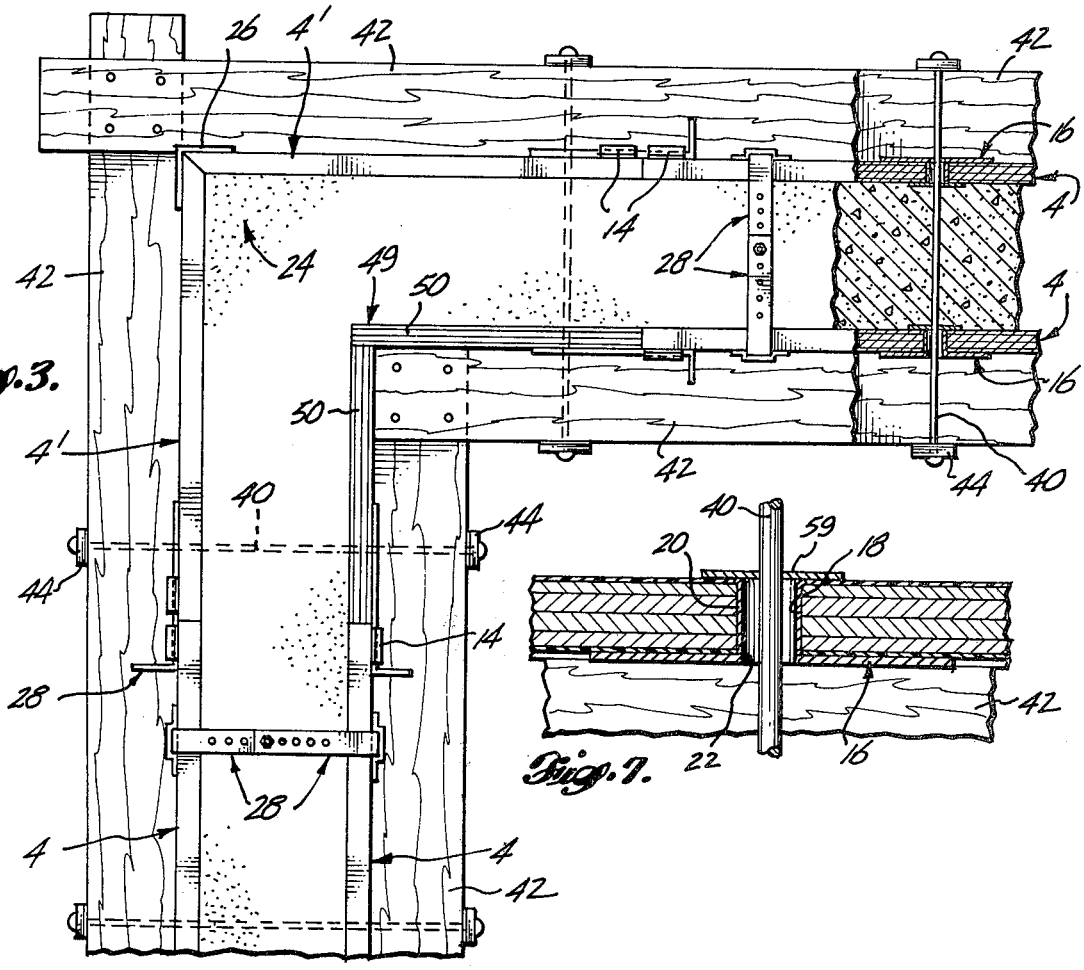
Fig. 7.

Fig. 11.
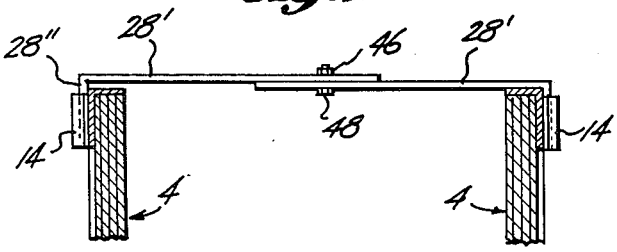
Fig. 12.
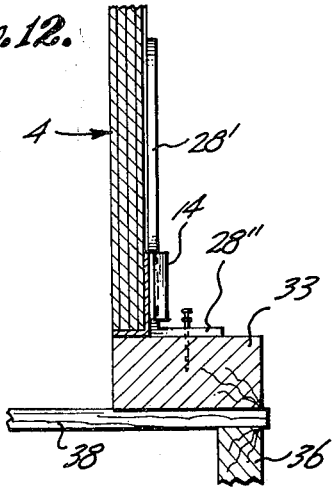
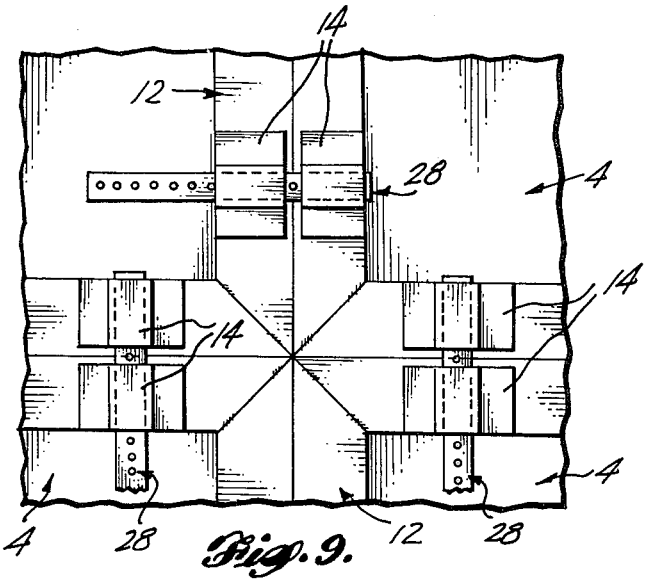
Fig. 9.
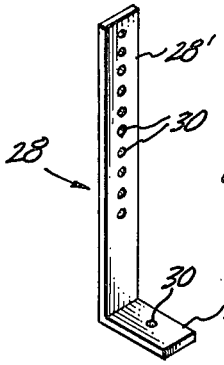
Fig. 10.
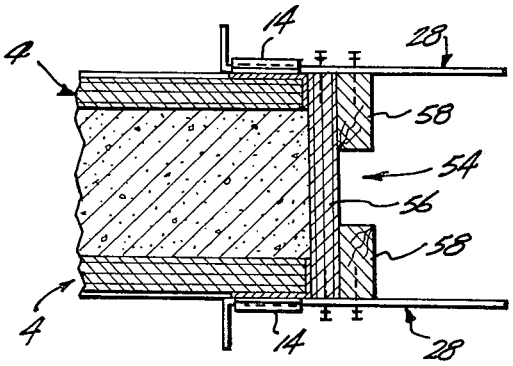
Fig. 14.
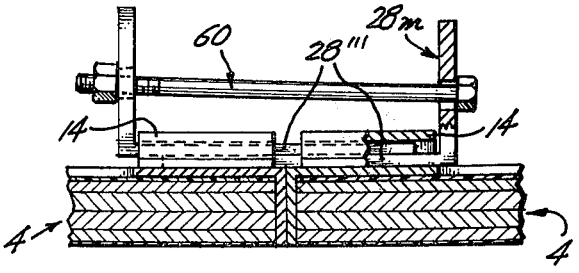
Fig. 13.

Fig. 16.
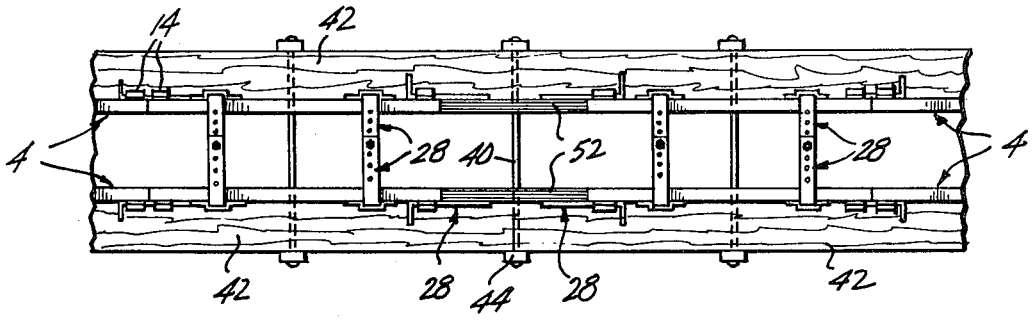
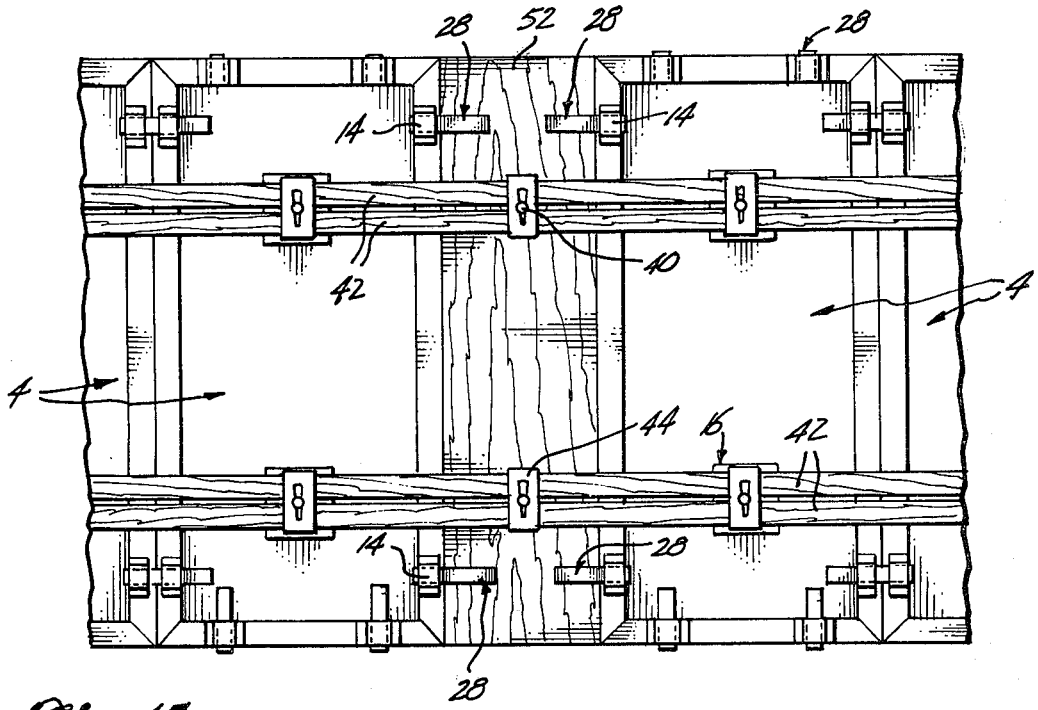
Fig. 15.

FORMING PANEL WITH CONNECTION MEANS FOR ABUTTING PANELS

This application is a division of Ser. No. 77,935 filed on Oct. 5, 1970, now U.S. Pat. No. 3,687,411.

FIELD OF THE INVENTION

This invention relates to a means for constructing reusable, multi-paneled forms for molding concrete and the like; and in particular to a means and technique of this nature wherein the forms are constructed from essentially no more than a plurality of marginally slotted panels and a plurality of keys which slidably engage in the slots to interlock the panels with one another on each side of the form, as well as to interlock the form from side to side.

BACKGROUND OF THE INVENTION INLCUDING CERTAIN OBJECTS THEREOF

Reusable, multi-paneled forms have been disclosed previously for molding concrete and the like, but in most such disclosures, they have required an elaborate array of additional elements with which firstly, to interlock the panels with one another and to interlock the form from side to side, and then to strip the form so that it can be reused at a new site.

One object of the present invention is to provide a means whereby a reusable, multi-paneled form can be constructed for molding concrete or the like, using only a single additional readily hand-strippable element to interlock the panels with one another on each side of the form and to interlock the form from side to side. Another object is to provide a means of this nature wherein the interlock element is employed at points which are spaced apart from one another about the margins of the outside faces of the panels, so that the spaces therebetween can be employed as bearing surfaces for studs, walers or other such shoring which is strung crosswise of the panels to further rigidify the assembly of the same. A further object is to provide a means of this nature wherein the interlock element interengages with the panels in such a fashion that the panels can be reinforced with framing material at the margins thereof, including framing members which run crosswise of the shoring without interfering with the interlock procedure. A still further object is to provide a means of this nature wherein the sides of the form can be cross-tied with one another at points other than on the margins of the panels, such as at points on the main center body sections of the panels within the margins thereof. Still another object is to provide a means of this nature wherein the same interlock element can be employed in filling out the form in all other regards, such as in fashioning the corners of a cornered form, or in providing bulkheads for a form, or in providing for windows, corbeling, or other such appointments which are to be incorporated into the finished product. A still further object is to provide a means of this nature wherein the interlock element is quickly engaged and stripped in and from the form, and operates to align the panels one to another immediately upon its engagement in the form. Still another object is to provide a means of this nature wherein the interlock element can be employed in making up gang forms for other such forms in which the panels are more permanently interlocked with one another. Other objects include the provision of a means of this nature wherein the panels can be made from light weight wood material, such as plywood, yet are tightly sealed against moisture over all surfaces thereof, including the surfaces of any holes for cross-ties therein; and wherein the panels are adapted to receive any form of cross-tie including snap ties, she bolts, and threaded rods, and are easily stacked or otherwise stored in a minimal amount of space. Still other objects include the provision of a means of this nature wherein the panels have a flat inside face which is highly conditioned as a parting surface, and edge formed so as to tightly abut from panel to panel, and thus virtually eliminate the presence of ridge lines in the molded concrete; and wherein the panels also have three contact points for shoring on the outside faces thereof, to virtually eliminate any deflection in the same when the shoring is clamped to them. Still further objects will become apparent from the description of the invention which follows hereafter.

SUMMARY OF THE INVENTION

These objects and advantages are realized by a means of my invention wherein a form is constructed from a plurality of similar flat-faced panels having spaced, co-planar, open-ended, edge-oriented slots in the margins of the other or opposite faces thereof; and a plurality of elongated L-shaped keys which are employed both to interlock the panels with one another on each side of the form and to interlock the form from side to side. The panels are arranged in two spaced, parallel, oppositely disposed, edge to edge, co-planar flat-faced arrays of the same; and are interlocked with one another in each array by placing a first set of the keys in the plane of the slots opposite points relatively within the margins of the panels, and slidably engaging the keys in the adjacent slots of adjacent panels. The arrays are interlocked with one another by placing a second set of the keys in the plane of the slots opposite points relatively without the margins of the panels, slidably engaging the latter keys in the slots of the panels along corresponding edges of the arrays, and interconnecting the latter keys with one another transversely of the space between the arrays.

The keys may be sized so that each individually slidably engages in a slot; or they may be sized so that they slidably interengage in pairs in an individual slot when slidably inserted through the opposite end openings thereof.

The keys employed to interlock the arrays with one another may be slidably engaged in their respective slots to project relatively away from one another outside the space between the arrays; or to project relatively toward one another in the space between the arrays. In the latter instance, they are normally interconnected by fastening them together in overlapping relationship with one another in the space; in the first instance, they must be fastened to some third member such as the footing structure of a wall form, which bridges the space between the arrays.

Where a dissimilar panel is abutted with a pair of spaced, parallel similar panels, for purposes of closing the space therebetween, the keys may be slidably engaged in the slots in the adjacent margins of the similar panels and projected relatively outwardly from the adjacent edges of the similar panels, to secure the dissimilar panel upright in the form. For example, to fill the gap between a pair of similar panels in the same array, the dissimilar panel is interposed edge to edge therebetween in the plane of the array, and the keys are projected to abut the adjacent face of the dissimilar panel. Or, in the case of a dissimilar panel extending crosswise of the space between the arrays and abutted with corresponding edges of opposing panels in the arrays, the keys are projected to abut the adjacent edges of the dissimilar panel.

In the preferred embodiments of the invention, the panels have U-shaped straps outstanding on the margins of the aforesaid other faces thereof, the channels of which form the slots in the margins. The keys take the form of flat, elongated bars having flat right angular flanges of equal thickness on one end thereof. The straps are spaced relatively inwardly from the edges of the panels by at least this thickness to enable the bars and flanges to stand on perpendiculars to the faces of the panels, within the edges of the same, when the keys are engaged in the channels of the straps from points of entry adjacent the edges.

Preferably the keys are apertured, both in the bars and in the flanges, to provide for securing them to one another, or to some third member such as a footing structure or one of the aforesaid dissimilar panels, by fastener means such as bolts or nails passed therethrough. Also, where a pair of keys are slidably interengaged in a single slot, fastener means such as bolts, may be employed to interconnect the flanges of the keys for a more permanent installation, such as in a gang form.

In certain of these embodiments, moreover, the panels have a raised marginal frame on the aforesaid other face thereof; and a co-planer bearing surface for shoring is raised on the face within the frame, at a point coincident with a line which is disposed on a parallel to one axis of the panel and extends through the space between a pair of straps along one edge of the panel, so that the shoring can make three point contact with the face of the panel between the straps. Preferably, the panel also has an aperture therein which opens into the bearing surface to pass a cross-tie therethrough adjacent the shoring. When the panel is constructed from a water permeable core material, the aperture has a water impermeable sleeve inserted therethrough flush with the flat face of the panel. The water permeable core material may also have a water impermeable coating on both the flat face and the aforesaid other face thereof, to seal it against moisture. Preferably, the coating on the flat face of the panel also acts as a parting film with respect to concrete.

BRIEF DESCRIPTION OF THE DRAWINGS

These features will be better understood by reference to the accompanying drawings which illustrate a presently preferred mode of practicing the invention in a form for molding a cornered concrete wall.

In the drawings, FIG. 1 is a part elevational view of the erected form on one side;

FIG. 2 is a cross-sectional view of the form along the line 2—2 of FIG. 1;

FIG. 3 is a part plan, part sectional view of a corner of the form;

FIG. 4 is a perspective view of one of the modular panels employed in erecting the form;

FIG. 5 is a similar view of a modular corner unit employed in erecting the same;

FIG. 6 is a part cross-sectional view of the panel in FIG. 4 along the line 6—6 thereof;

FIG. 7 is another such view of the panel along the line 7—7 of FIG. 4, but as it is seen in use in the form;

FIG. 8 is a part cross-sectional view of the main center section of the panel, again as it is seen in use;

FIG. 9 is a part elevational view of the form on one side, at a point where four panels are abutted and interlocked with one another by a set of L-shaped keys;

FIG. 10 is a perspective view of one of the keys;

FIG. 11 is a part cross-sectional view of the form, illustrating the manner in which the keys are employed to interlock the sides of the form across the top;

FIG. 12 is a part cross-sectional view of one side of the form, illustrating the manner in which the sides are secured to the footing structure of the form using the keys;

FIG. 13 is a part sectional view at a joint between a pair of panels which are more permanently interlocked by a pair of bolt-interconnected keys, as for example, where the panels are to be used as part of a gang form;

FIG. 14 is a part cross-sectional view of a form, illustrating the manner in which the keys are used to secure the panels to a bulkhead and vice versa;

FIG. 15 is a part elevational view of one side of the form, illustrating the manner in which allowance is made on either or both sides for odd dimensions in the modular assembly; and FIG. 16 is a part plan view of the form at a point corresponding to that of FIG. 15.

DESCRIPTION OF THE PREFERRED EMBODIMENT

Referring to the drawings, it will be seen that the wall form comprises a plurality of modular panels 4 which are arranged in co-planar array and abutted edge to edge with one another to define each side of the form. The individual panels 4 are constructed from a 2 foot × 4 foot plywood core 6 which is typically 1 inch thick and coated with a polyester resin material 8 on both faces thereof. In addition, the coating 8 on the relatively inside face of the panels, from the standpoint of their use in the form, is reinforced with wovern fiberglass material 10; and the edges and coated, relatively outside margins of the same are covered and reinforced by a frame 12 of ¼ inch thick, flat, right angularly flanged, extruded aluminum bar material which is sized and bonded to the edges and margins so as to be flush with the coated inside face of the panels. Each panel also comprises a set of outwardly flanged, U-shaped straps 14 which are bonded or otherwise secured to the margins of the frame, two for each stile 12′ and each rail 12″ of the frame, and spaced apart in mutual alignment with one another, from stile to stile or rail to rail.

Finally, each panel is also equipped with a pair of apertured, waler bearing plates 16 which are one fourth inch in thickness to match the thickness of the frames, and bonded or otherwise secured on the coated, outside face of the panel, at equally spaced points inboard from the rails, along the longitudinal or major axis of the panel. At these points, moreover, the panels have apertures 18 therein; and the plates have eyelets 20 outstanding on the inside faces therof, about the aperture 22 therein, which are slidably inserted in the apertures 18 in the panels, and flared or otherwise flushed out with the coated inside faces of the panels.

Each corner panel unit 24 is right angular in construction, and comprises a pair of the aforedescribed panels 4′ for the sides of the form, which are suitably interconnected and modified to account for conditions at the outside corners of the form. Firstly, the adjacent edges of the panels 4′ are mitered to abut edge to edge at the angle of the corner, and their abutting edges are overlaid and reinforced with right angular clips 26 which are bonded or otherwise secured to the relatively adjacent stiles 12' of the panels at the edges. Moreover, the rails 12'' of the respective panels are equipped with only a single strap 14 each, and the straps 14 are displaced to points adjacent the relatively remote stiles of the panels. Similarly, the waler bearing plates 16 are also displaced to points adjacent these stiles; and, of course, there are no straps along the relatively adjacent stiles of the panels.

In the wall form, the panels are interlocked with one another by sets of two-legged L-shaped keys 28 which are also employed as the means for interconnecting the respective sides of the form at the top and bottom, as well as the means for filling out the form in all other regards, as shall be explained. Each key 28 comprises a flat, elongaged bar 28' having a longitudinally extending series of equally spaced apertures 30 therein, and a flat, right angular flange 28'' on one end thereof which is also apertured. The transverse body dimensions of the bar and the flange are the same; and in addition, the transverse body dimensions of both correspond to the transverse dimensions of the channels 32 in the straps to the extent that either is slidably interengagable in the channel 32 of a strap, although the bar 28' projects to a far greater extent on the other side of the channel than does the flange 28''.

Assuming that a form height of more than 4 feet is needed, the panels are stacked in tiers upright on edge on a pair of spaced parallel base plates 33 overlaid on a conventional footing structure 34 of spaced parallel 2 × 6 or 2 × 8 boards 36 laid on edge and interconnected by transversely disposed 1 × 4 material 38 at intervals along the length of the form. Initially at each side of the form keys 28 are held in hand in the plane of the channels 32, at points relatively outside the margins of the panels, and are passed upward through the channels of the straps on the lower rail 28'' of the panels in the lower or lowermost tier in the form. Then, these latter panels are arranged flush with the inside or relatively adjacent edges of the base plates 33, and the flanges 28'' of the keys are nailed or otherwise secured to the tops of the plates. At the same time, the panels are abutted stile to stile with one another, and other keys are held at points relatively inside the margins of the panels and passed through the mutually aligned straps on the stiles to interlock the panels lengthwise of the tier, there being sufficient projecting length in the bars of the keys to interconnect the straps as seen. On the other hand, the bars are not so long that the keys interfere with one another, from rail to stile, at the corners of the panels.

As the lowermost tier of panels is erected on each side, moreover, conventional snap ties 40 are inserted through the mutually opposing eyeleted apertures 18 in the panels, and pairs of spaced parallel walers 42 are stratled to either side of the projecting ends of the ties and held in place lengthwise of the tier, to be clamped to the tier by wedge-like tie clamps 44 in conventional fashion. When clamped, the walers bear against the stiles of the panels, as well as the bearing plates interposed therebetween.

Next, the second and still higher tiers of panels are added on each side of the form, and again keys are used, not only to interlock the panels in each tier, but also to interlock the abutting rails of the panels from one tier to the next. Also, more sets of walers are added and clamped together by additional snap ties in the same manner as was done with the first tier of panels.

Finally, additional keys are employed to interconnect the top tier of panels from one side of the form to the other. In this instance, the flanges of the keys are held in hand in the plane of the channels at points outside the margins of the panels, and are dropped into the straps on the top stiles of the panels, with the bars of the keys extending toward one another so as to overlap in the manner of FIG. 10, the key on the left being slightly raised to allow for the overlap therebetween. Then, nuts 46 and bolts 48, or other such means, are employed to interconnect the keys through mutually registering apertures of the overlapping bars of the keys.

At the corner or corners of the form, a pair of corner units 24 are stacked one on the other to form the outside of the corner, as seen in FIG. 3. Once again, keys 28 are employed to interlock the units with one another, and with the adjacent wall panels 4 of the tiers on each side. Also, the bottom corner panel unit 24 is secured to the base plates 33 at the outside of the corner by means of keys, in the same fashion as was done with the wall units in FIG. 12.

The inside 49 of the corner is made up on the job from two or more pieces of 1¼ inch plywood 50 joined in a right angle as in FIG. 3. Backing for the corner 49 is provided not only by the walers, but also by additional keys 28 which are passed through the straps on the adjacent stiles of the panels 4 to each side of the corner. Holes are drilled in the plywood 50 corner to accommodate the snap ties passed across the form from the bearing plates 16 of the outside corner 24.

A similar technique is used to allow for any variation in the length of the wall relative to the nearest multiple of the panel width. Thus, in FIGS. 15 and 16 a sheet of plywood 52 is cut and interposed between a pair of panels, on each side of the form, and backed by keys 28, to take up the difference. The plywood 52 may be secured to the keys through the apertures 30 of the same, if desired. However, the flanges 59 (FIG. 7) of the snap ties 40 serve to space the sheets of plywood 52 apart, and they are retained in this condition by the bars 28' of the keys.

When a bulkhead 54 is needed, the technique of FIG. 14 is employed. A strip of plywood 56 of appropriate width is abutted against the exposed vertical edges of the adjacent panels 4, and keys 28 are passed through the straps on the stiles of the panels, and secured to the plywood 56 by nails driven through apertures 30 of the same. Blocking, such as vertical studding 58, may be used to reinforce the assembly on the back face of the plywood strip 56.

If it is desired to assemble a plurality of panels in gang form which can be moved in mass by a crane boom or the like, the panels can be more permanently interlocked in the manner of FIG. 13. In this instance, keys 28m are employed, whose bars 28''' are one-half the thickness of the keys 28 employed elsewhere; and the keys 28m are slidably interengaged in a strap, and then bolted flange to flange in the manner at 60 in FIG. 13.

I claim:

1. A forming member comprising a quadrilateral panel, the edges of which are straight from corner to corner thereof, said panel having a flat operatively interiorly oriented face and a raised marginal frame around the perimeter of the operatively exteriorly oriented face thereof, which frame has a flat face adapted to serve as a bearing surface for a waler, and pairs of connector means laterally outstanding therefrom, at spaced points thereon, which define pairs of spaced, coplanar, open-ended, edge oriented slots on all four sides of the panel, the open ends of which slots are spaced inwardly from the adjacent edges of the panel to enable one leg of an L-shaped key to be inserted in each slot while the other leg of the key is interposed in laterally outstanding condition from the frame, between the slot and the adjacent edge of the panel, said pairs of connector means being aligned with one another on spaced lines extending parallel to the axes of the panel, between the opposing sides thereof, and there being an apertured intermediate bearing surface for the waler raised on the operatively exteriorly oriented face of the panel, which is coplanar with the face of the frame, but disposed within the frame at a point positioned intermediate opposing sides of the panel in the space between the pairs of connector means thereadjacent, so that the waler can make three pointed contact with the intermediate surface and the frame within the space between the latter pairs of connector means.

2. The forming member according to claim 1 wherein the connector means take the form of inverted U-shaped straps which are spaced apart from one another at said points on the frame.

3. The forming member according to claim 1 wherein the frame is L-shaped in cross section and secured to the edge of the panel so as to cover the edge.

4. The forming member according to claim 1 wherein the aperture of the intermediate bearing surface has a water impermeable sleeve inserted therethrough, flush with the operatively interiorly oriented face of the panel.

5. The forming member according to claim 1 wherein both faces of the panel have a resinous plastic coating thereon.

* * * * *